United States Patent [19]

Roeder et al.

[11] Patent Number: 4,551,728

[45] Date of Patent: Nov. 5, 1985

[54] APPARATUS FOR RAPID SWITCH CONICAL SCAN FEED

[75] Inventors: Robert S. Roeder, Dunedin; Peter M. Sterghos, St. Petersburg, both of Fla.

[73] Assignee: Sperry Corporation, New York, N.Y.

[21] Appl. No.: 515,423

[22] Filed: Jul. 20, 1983

[51] Int. Cl.[4] ..... H01Q 3/18

[52] U.S. Cl. ..... 343/761; 343/765

[58] Field of Search ..... 343/759, 761, 765, 766; 74/1 R

[56] References Cited

U.S. PATENT DOCUMENTS 2,574,376 11/1951 Childs et al. ..... 343/759

3,541,561 11/1970 Chubb ..... 343/759

*Primary Examiner*—Eli Lieberman

*Attorney, Agent, or Firm*—Howard P. Terry

[57] ABSTRACT

An apparatus for rapidly starting and stopping a conical scan antenna beam in which a feed rotating about a centerline provides a non-conical scan antenna beam during a search mode. When a target is detected a solenoid moves an actuator pin which displaces one end of the feed from the centerline providing a conical scan antenna beam for target tracking.

5 Claims, 5 Drawing Figures

SEARCH SCAN RASTER

TRACK CONICAL SCAN

APPARATUS FOR RAPID SWITCH CONICAL SCAN FEED

BACKGROUND OF THE INVENTION

1. Field of the Invention

This invention pertains to an apparatus for rapidly starting and stopping a conical scan antenna beam.

2. Description of the Prior Art

All tracking radars use some arrangement to offset the antenna feed to sense angle line-of-sight to the target with respect to the antenna tracking line-of-sight (i.e. the boresight or centerline axis). The feed offset arrangement may be a conical scan, various forms of lobe switching or monopulse. Conical scanning is often preferred in air-to-ground millimeter wave seekers, because it offers less complexity and lower cost than lobe switching or monopulse.

One type of conical scan tracking system used in air-to-ground millimeter wave seekers operates with the conical scan (tracking mode) inactive during the search mode. When a target is detected, the conical scan (tracking mode) is activated to track the target. This system suffers from frequent loss of target as the system switches from the search mode to the conical scan (tracking mode). Loss of target may occur during the several hundred milliseconds required for the motor driving the conical scan feed to reach the speed necessary to generate tracking error signals.

An alternate design eliminates switchover from search to tracking mode by keeping the conical scan activated during the search mode. This design yields a continuous composite (search and tracking) pattern. Thus, when a target is detected there is no mechanical delay in switching from target search to target track. However, the composite scan design requires a complex target detection technique to demodulate the composite scan and provide two-dimensional spatial matched filtering. Such a composite scan system is described in U.S. Pat. No. 4,150,379 issued Apr. 17, 1979 to J. Connors and assigned to the asignee of the present invention.

The present invention avoids the potential loss of target by switching from the search mode to the conical scan (tracking mode) far more rapidly than the previous design. Thus, targets are not lost during the time conical scan is being activated. Further, since there is no composite (search plus tracking) scan during the search mode, a less complex spatial match filter target detection algorithm may be used. The present invention is also less susceptible to jamming since there is no composite scan during the search mode.

SUMMARY OF THE INVENTION

The apparatus of the present invention is an electromechanical technique for rapidly starting and stopping a conical scan antenna beam in a millimeter wave missile seeker. The invention provides the capability for rapid handover from a target search mode to a target track mode in a high speed terminally guided missile without risk of losing the target track. The rapid switch conical scan feed provides a fixed beam during target search and a conically scanned beam during target tracking. The feed rotates at a fixed velocity in both target search and target track modes. In the target search mode the feed is rotating about the antenna boresight axis (centerline). When activated to target track, a solenoid mechanically offsets the feed to a conical scan position. The transition from search mode to conical scan tracking mode takes less than one rotation of the conical scan feed. The transition time is less than 10 ms when the feed is rotating at 6000 rpm.

FIGS. *2a* and *2b* are diagrams of a typical search and track scan patterns.

FIGS. *3a* and *3b* are the rapid switch conical scan feed structure.

DESCRIPTION OF THE PREFERRED EMBODIMENTS

Figure 1:
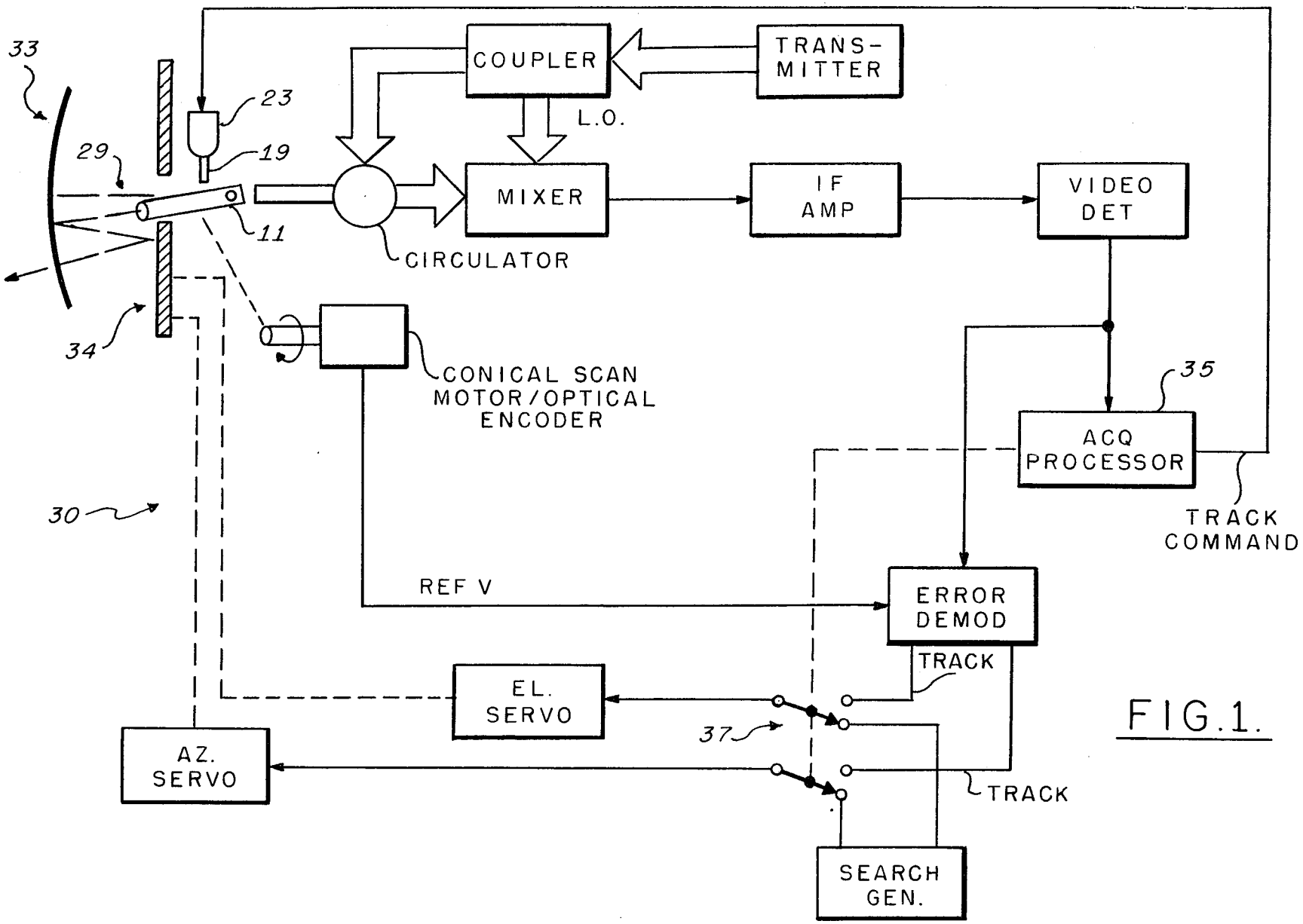
FIG. 1 is a block diagram of a typical conical scan radar with a rapid switch feed.
Figure 2A:
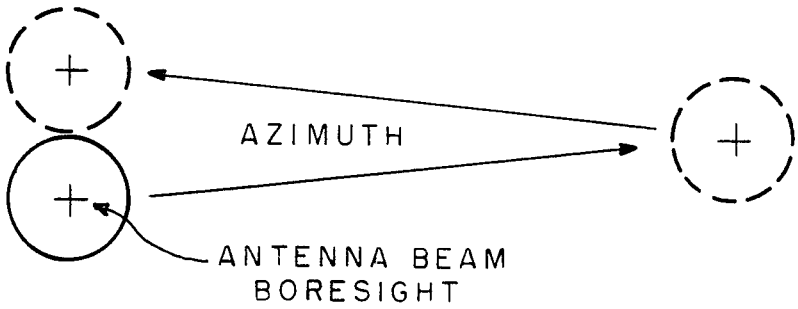
Figure 2B:
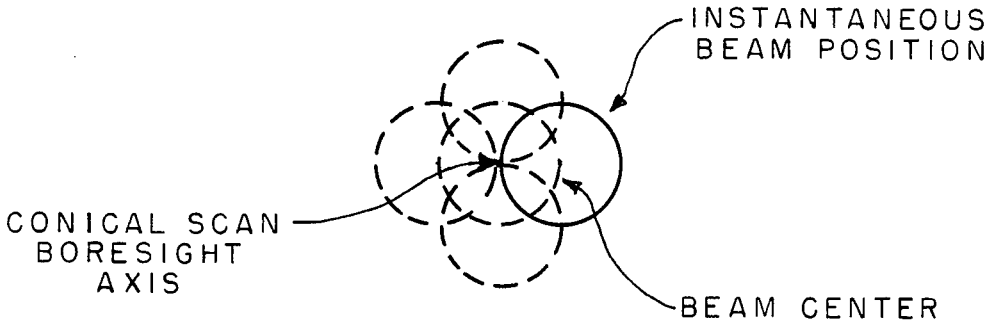

A block diagram 30 of the basic conical scan radar system with the rapid switched feed is shown in FIG. 1. For target search, the solenoid 23 is not activated and the feed 11 is rotating in a "zero offset" position aligned along the centerline axis 29. The antenna beam formed by the fixed parabolic reflector 33 and the gimballed polarization twist reflector 34 can be scanned in a typical search pattern such as the raster scan shown in FIG. *2a*. When the antenna beam scans across a target, the acquisition processor 35 detects the target and sends a command to activate the solenoid 23. An actuator pin 19 then forces the feed 11 into a fixed offset position as illustrated in FIG. 1. At the same time, the acquisition processor 35 activates the switches 37 and transfers the gimbal drive signals from target search to target track. The boresight for centerline axis of the conical scan beam is controlled by driving the twist reflector plate 34 in azimuth and elevation in response to the tracking error signals. The error signals are proportional to the difference between the target track line of sight and the conical scan boresight line of sight resolved into the azimuth and elevation gimbal coordinates. A typical conical scan tracking pattern is shown in FIG. *2b*.

Figures 3, 3A, 3B:
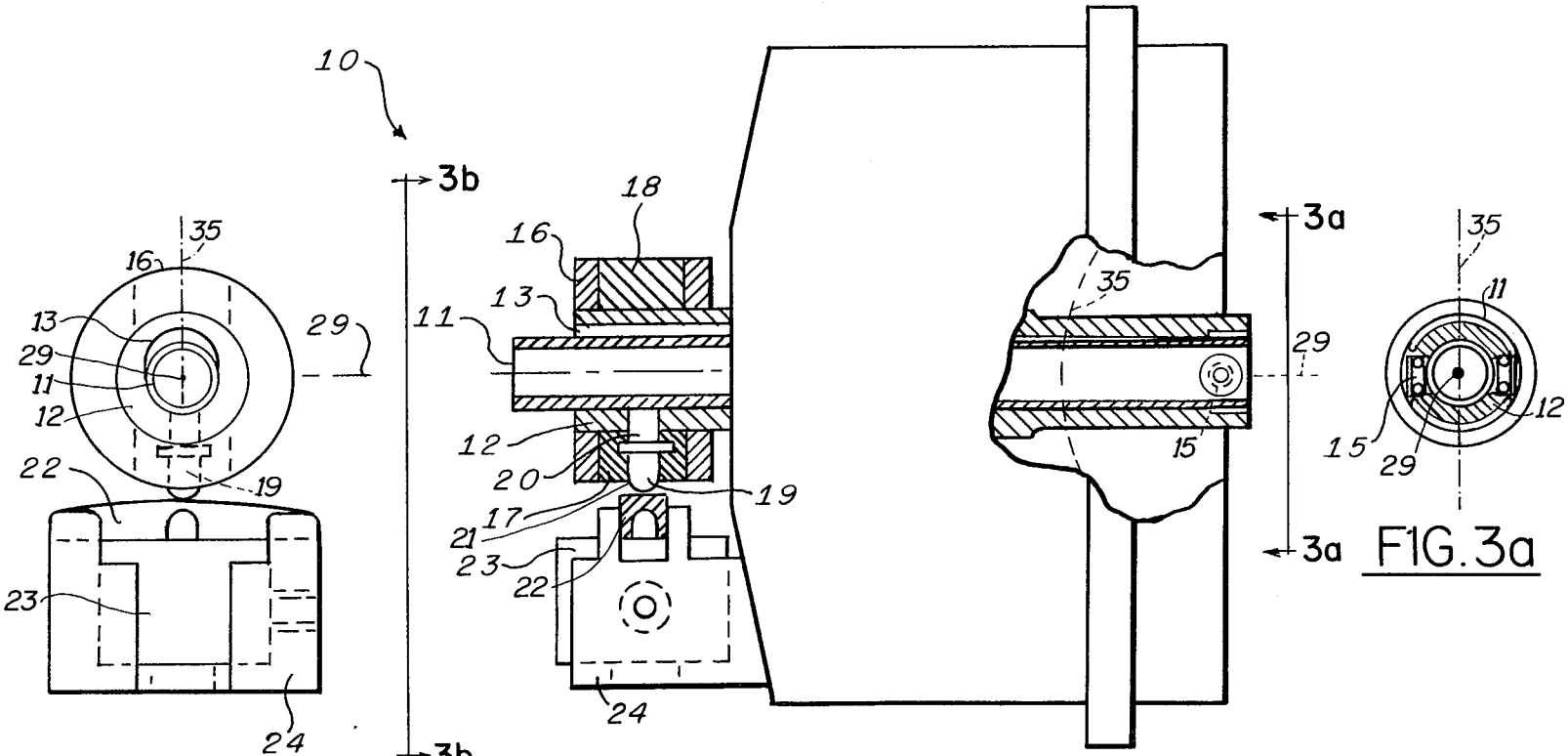

Referring now to FIG. *3a*, and FIG. *3b* a rapid switch conical scan feed apparatus 10 includes a feed 11 which may be a thin wall ferrous cylinder open at both ends and plated to improve conductivity on its inner surface. Feed 11 is housed within another open cylinder 12 that may be a hollow motor shaft coupled to or an extension of a motor rotor (not shown). The inner surface 13 of cylinder 12 is elliptical shaped at the end in proximity to actuator pin 19. The elliptical shaped inner surface 13 of cylinder 12 tapers over the length of cylinder 12 such that the end of cylinder 12, containing recessed bearings 15, has a circular shape that just accommodates the outer diameter of feed 11. Feed 11 is thus free to pivot on bearings 15 about arc 35 as shown in FIGS. 3, *3a* and *3b*.

A collar 16 is coupled to the outer surface of cylinder 12 near end 13 and includes a magnet 17, a counterweight 18 and an actuator pin 19 made of a nonferrous material. The actuator pin 19 extends through the magnet 17 and through the wall of cylinder 12. The end 20 of actuator pin 19 is flush with the inner surface of the cylinder 12. A cam 22, coupled to the solenoid 23, both supported by housing 24 is positioned so that the cam 22 will come into contact with the end 21 of the actuator pin 19 when the solenoid 23 is energized.

Referring again to FIGS. 3, *3a* and *3b* the operation of the rapid switch conical scan feed apparatus 10 will now be explained. The following numbered parts are rotating as a unit—feed 11, cylinder 12, collar 16, magnet, 17, counterweight 18 and actuator pin 19. The rotating parts being driven at a constant veocity, for example 6000 rpm, by a conical scan motor (not shown). In the target search mode described previously, feed 11 is held in the position shown in FIGS. 3 and 3*b* by magnet 17. Although feed 11 is rotating, there is no conical scan since both ends of feed 11 are rotating about centerline 29. When a target is detected and target tracking is desired, solenoid 23 is activated by acquisition processor 35 illustrated in FIG. 1. Solenoid 23, when activated, pushes cam 22 into the path of rotating actuator pin 19. As actuator pin 19 strikes cam 22, pin 19 is pushed toward centerline 29 thereby forcing feed 11 to pivot on bearing 15 about arc 35. Thus, the end of feed 11 in proximity to actuator pin 19 becomes offset from centerline 29 by the movement of actuator pin 19 toward centerline 29. Once feed 11 is offset from centerline 29, centrifugal force generated by the rotating feed is sufficient to overcome the pull of magnet 17 and thus feed 11 remains in the offset position as long as rotation is maintained at the constant operational velocity previously noted as 6000 rpm. Solenoid 23 need not remain activated to maintain feed 11 in the offset position.

With feed 11 offset, the conical scanning pattern is produced. The offset end of feed 11 is nutating about centerline 29 while the pivoted end of feed 11 remains rotating about centerline 29. Switching time from search mode to conical scan is less than one full rotation of the feed 11 or less than 10 milliseconds when the feed is rotating at 100 rpm. Conical scanning can be stopped by de-energizing the motor (not shown) driving feed 11. As the speed of rotation of feed 11 decreases, the feed 11 is pulled back to the centerline 29 by magnet 17.

We claim:

1. An apparatus for rapidly starting and stopping a conical scan antenna beam comprising:

feed means having a centerline and first and second ends for directing electromagnetic energy, said feed means includes a hollow circular cylinder, cylindrical rotating means having first and second ends and a hollow inner region for rotating said feed means about a line coincident with said centerline, said hollow inner region being circular at said first end of said rotating means and elliptical at said second end of said rotating means, said feed means inserted in said hollow inner region with said first end of said feed means pivotally mounted at said first end of said hollow inner region, and means for displacing said feed means a predetermined distance at said second end from said coincident line.

2. An apparatus in accordance with claim 1 which further includes bearing means on the inner wall of said rotating means for pivoting said feed means such that when said second end of said feed means is displaced said first end continues to rotate about said centerline.

3. An apparatus for rapidly starting and stopping a conical scan antenna beam as recited in claim 1 wherein said means for displacing said second end of said feed includes an actuating means rotating with said rotating means.

4. An apparatus in accordance with claim 3 which further includes means for forcing said actuating means against said feed means to provide displacement of said feed means at said second end.

5. An apparatus in accordance with claim 4 which further includes means for holding said feed means on said centerline before displacement of said second end of said feed means, and for returning said feed means to said centerline when displacement of said second end is no longer desired.

* * * * *